US009273858B2

(12) United States Patent
King et al.

(10) Patent No.: US 9,273,858 B2
(45) Date of Patent: Mar. 1, 2016

(54) SYSTEMS AND METHODS FOR LOW-POWER LAMP COMPATIBILITY WITH A LEADING-EDGE DIMMER AND AN ELECTRONIC TRANSFORMER

(71) Applicant: Cirrus Logic, Inc., Austin, TX (US)

(72) Inventors: Eric Jerome King, Dripping Springs, TX (US); Daniel J. Baker, Austin, TX (US); John L. Melanson, Austin, TX (US)

(73) Assignee: Phillips International, B.V., Eindhoven (NL)

( * ) Notice: Subject to any disclaimer, the term of this patent is extended or adjusted under 35 U.S.C. 154(b) by 343 days.

(21) Appl. No.: 13/903,591

(22) Filed: May 28, 2013

(65) Prior Publication Data

US 2014/0167639 A1 Jun. 19, 2014

Related U.S. Application Data

(60) Provisional application No. 61/736,942, filed on Dec. 13, 2012, provisional application No. 61/756,744, filed on Jan. 25, 2013.

(51) Int. Cl.

| | |
|---|---|
| ***H05B 37/00*** | (2006.01) |
| ***F21V 23/02*** | (2006.01) |
| ***H05B 33/08*** | (2006.01) |

(52) U.S. Cl.

CPC ..... *F21V 23/02* (2013.01); *H05B 33/0815* (2013.01); *H05B 33/0839* (2013.01)

(58) Field of Classification Search

CPC ..... H04B 33/0839; H04B 33/0809; H04B 33/0815; H04B 33/0845; H04B 33/0818; H04B 37/02; H02M 3/335; H02M 3/33507; F21V 23/02

USPC ..... 315/239, 307, 228, 247, 254, 224, 297, 315/294, 291, 279, 308, 360, 209 R; 363/20, 363/16; 327/77–79

See application file for complete search history.

(56) References Cited

U.S. PATENT DOCUMENTS 3,806,829 A 4/1974 Duston et al.
4,008,414 A * 2/1977 Agnew ..... 315/97

(Continued)

FOREIGN PATENT DOCUMENTS

EP 2403120 A2 1/2012
EP 2590477 A1 5/2013

(Continued)

OTHER PUBLICATIONS

International Search Report and Written Opinion, International Patent Application No. PCT/US2013/047777, mailed Jun. 26, 2014, 21 pages.

(Continued)

*Primary Examiner* — Lincoln Donovan
*Assistant Examiner* — Thomas Skibinski
(74) *Attorney, Agent, or Firm* — Jackson Walker L.L.P.

(57) ABSTRACT

Methods and systems to provide compatibility between a load and a secondary winding of an electronic transformer driven by a leading-edge dimmer may include: (a) responsive to determining that energy is available from the electronic transformer, drawing a requested amount of power from the electronic transformer thus transferring energy from the electronic transformer to an energy storage device in accordance with the requested amount of power; and (b) transferring energy from the energy storage device to the load at a rate such that a voltage of the energy storage device is regulated within a predetermined voltage range.

39 Claims, 5 Drawing Sheets

(56) References Cited

U.S. PATENT DOCUMENTS

| | | | | |
|---|---|---|---|---|
| 4,562,382 | A | 12/1985 | Elliott | |
| 5,040,236 | A | 8/1991 | Costello | |
| 5,089,753 | A | 2/1992 | Mattas | |
| 5,416,387 | A | 5/1995 | Cuk et al. | |
| 5,583,402 | A | 12/1996 | Moisin et al. | |
| 5,650,694 | A | 7/1997 | Jayaraman et al. | |
| 5,872,429 | A | 2/1999 | Xia et al. | |
| 6,369,461 | B1 | 4/2002 | Jungreis et al. | |
| 6,407,935 | B1 | 6/2002 | Chang et al. | |
| 7,812,550 | B2 | 10/2010 | Harmgardt et al. | |
| 8,067,902 | B2 | 11/2011 | Newman, Jr. et al. | |
| 8,212,491 | B2 | 7/2012 | Kost et al. | |
| 8,547,034 | B2 | 10/2013 | Melanson et al. | |
| 8,653,759 | B2 | 2/2014 | Vigh et al. | |
| 8,664,883 | B2 | 3/2014 | Hiramatu et al. | |
| 8,698,483 | B2 | 4/2014 | Riesebosch | |
| 8,716,957 | B2 | 5/2014 | Melanson et al. | |
| 8,723,431 | B2 | 5/2014 | Deppe et al. | |
| 8,742,674 | B2 | 6/2014 | Shteynberg et al. | |
| 8,928,243 | B2 | 1/2015 | Potter et al. | |
| 8,933,648 | B1 | 1/2015 | Putman et al. | |
| 9,072,125 | B2 | 6/2015 | King et al. | |
| 9,167,664 | B2 | 10/2015 | Kie et al. | |
| 9,215,765 | B1 | 12/2015 | Mokry et al. | |
| 9,215,770 | B2 | 12/2015 | Mazumdar et al. | |
| 2003/0127994 | A1 | 7/2003 | Patchornik et al. | |
| 2003/0151931 | A1 | 8/2003 | Kohno | |
| 2005/0174162 | A1 | 8/2005 | Cheng et al. | |
| 2005/0249667 | A1 | 11/2005 | Tuszynski et al. | |
| 2006/0147371 | A1 | 7/2006 | Tuszynski et al. | |
| 2007/0040516 | A1 | 2/2007 | Chen | |
| 2007/0076459 | A1 | 4/2007 | Limpkin | |
| 2007/0262654 | A1 | 11/2007 | Mosebrook et al. | |
| 2007/0285028 | A1 | 12/2007 | Tsinker et al. | |
| 2008/0013343 | A1 | 1/2008 | Matthews | |
| 2008/0018261 | A1 | 1/2008 | Kastner | |
| 2008/0024074 | A1 | 1/2008 | Mosebrook et al. | |
| 2008/0119421 | A1 | 5/2008 | Tuszynski et al. | |
| 2008/0224636 | A1 | 9/2008 | Melanson | |
| 2009/0184652 | A1 | 7/2009 | Bollinger, Jr. et al. | |
| 2009/0184662 | A1 | 7/2009 | Given et al. | |
| 2009/0295292 | A1 | 12/2009 | Harmgardt et al. | |
| 2010/0013409 | A1 | 1/2010 | Quek et al. | |
| 2010/0141178 | A1 | 6/2010 | Negrete et al. | |
| 2010/0164406 | A1* | 7/2010 | Kost et al. | 315/307 |
| 2010/0225251 | A1 | 9/2010 | Maruyama | |
| 2010/0244726 | A1 | 9/2010 | Melanson | |
| 2011/0012530 | A1 | 1/2011 | Zheng et al. | |
| 2011/0115400 | A1 | 5/2011 | Harrison et al. | |
| 2011/0121751 | A1 | 5/2011 | Harrison et al. | |
| 2011/0121752 | A1 | 5/2011 | Newman, Jr. et al. | |
| 2011/0121754 | A1 | 5/2011 | Shteynberg et al. | |
| 2011/0127925 | A1 | 6/2011 | Huang et al. | |
| 2011/0199017 | A1 | 8/2011 | Dilger | |
| 2011/0210674 | A1 | 9/2011 | Melanson | |
| 2011/0266968 | A1 | 11/2011 | Bordin et al. | |
| 2011/0309759 | A1 | 12/2011 | Shteynberg et al. | |
| 2012/0025729 | A1 | 2/2012 | Melanson et al. | |
| 2012/0043913 | A1 | 2/2012 | Melanson | |
| 2012/0049752 | A1 | 3/2012 | King et al. | |
| 2012/0098454 | A1 | 4/2012 | Grotkowski et al. | |
| 2012/0106216 | A1 | 5/2012 | Tzinker et al. | |
| 2012/0112638 | A1 | 5/2012 | Melanson et al. | |
| 2012/0112648 | A1 | 5/2012 | Hariharan | |
| 2012/0119669 | A1 | 5/2012 | Melanson et al. | |
| 2012/0139431 | A1 | 6/2012 | Thompson | |
| 2012/0146546 | A1 | 6/2012 | Hu et al. | |
| 2012/0169240 | A1 | 7/2012 | Macfarlane | |
| 2012/0229041 | A1 | 9/2012 | Saes et al. | |
| 2012/0230073 | A1 | 9/2012 | Newman et al. | |
| 2012/0242238 | A1 | 9/2012 | Chen et al. | |
| 2012/0286684 | A1 | 11/2012 | Melanson et al. | |
| 2012/0286696 | A1 | 11/2012 | Ghanem | |
| 2012/0286826 | A1 | 11/2012 | King | |
| 2012/0299501 | A1 | 11/2012 | Kost et al. | |
| 2013/0002163 | A1 | 1/2013 | He et al. | |
| 2013/0113458 | A1 | 5/2013 | Riesebosch | |
| 2013/0278159 | A1 | 10/2013 | Del Carmen, Jr. et al. | |
| 2014/0009078 | A1 | 1/2014 | Xie et al. | |
| 2014/0009079 | A1 | 1/2014 | Xie et al. | |
| 2014/0009082 | A1 | 1/2014 | King et al. | |
| 2014/0028214 | A1 | 1/2014 | Mazumdar et al. | |
| 2014/0167652 | A1 | 6/2014 | King et al. | |
| 2014/0239832 | A1 | 8/2014 | Shteynberg et al. | |
| 2014/0333205 | A1 | 11/2014 | Kost et al. | |
| 2015/0061536 | A1 | 3/2015 | Xie et al. | |

FOREIGN PATENT DOCUMENTS

| | | | |
|---|---|---|---|
| WO | 2011063205 | A1 | 5/2011 |
| WO | 2011111005 | A1 | 9/2011 |
| WO | 2013072793 | A1 | 5/2013 |
| WO | 2013090904 | A1 | 6/2013 |

OTHER PUBLICATIONS

International Search Report and Written Opinion, International Patent Application No. PCT/US2013/047844, mailed Jul. 23, 2014, 14 pages.

International Search Report and Written Opinion, International Patent Application No. PCT/US2014/032182, mailed Jul. 24, 2014, 10 pages.

International Search Report and Written Opinion, International Patent Application No. PCT/US2014/037864, mailed Sep. 29, 2014, 8 pages.

International Search Report and Written Opinion, International Patent Application No. PCT/US2013/071690, mailed Jun. 4, 2014, 13 pages.

International Search Report and Written Opinion, International Patent Application No. PCT/US2015/035052, mailed October 21, 2015, 11 pages.

* cited by examiner

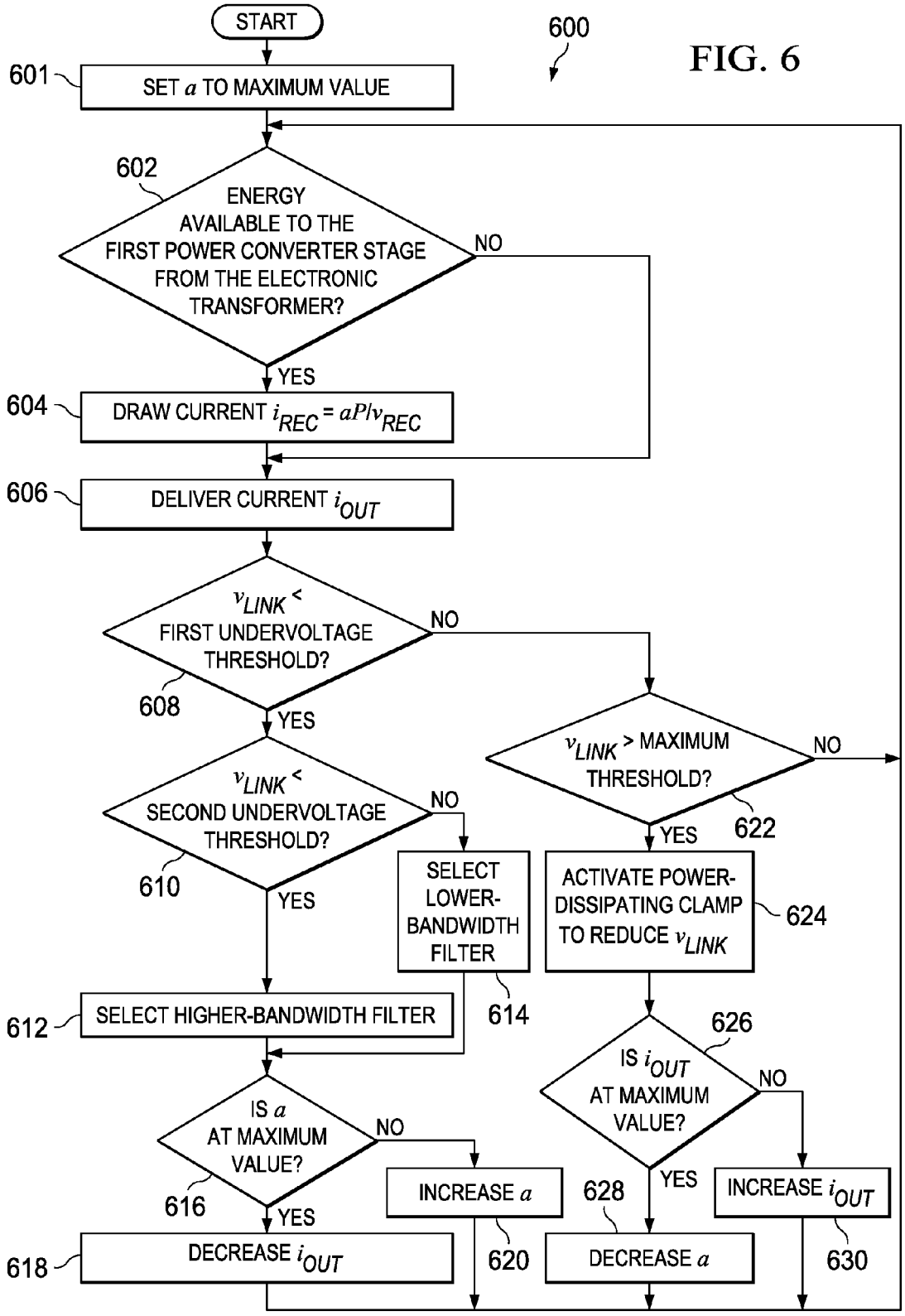
START
600
FIG. 6
601
SET a TO MAXIMUM VALUE
602
ENERGY AVAILABLE TO THE FIRST POWER CONVERTER STAGE FROM THE ELECTRONIC TRANSFORMER?
NO
YES
604
DRAW CURRENT $i_{REC} = aP/v_{REC}$
606
DELIVER CURRENT $i_{OUT}$
$v_{LINK}$ < FIRST UNDERVOLTAGE THRESHOLD?
NO
608
YES
$v_{LINK}$ > MAXIMUM THRESHOLD?
NO
YES
622
$v_{LINK}$ < SECOND UNDERVOLTAGE THRESHOLD?
NO
610
YES
SELECT LOWER-BANDWIDTH FILTER
614
ACTIVATE POWER-DISSIPATING CLAMP TO REDUCE $v_{LINK}$
624
612
SELECT HIGHER-BANDWIDTH FILTER
626
IS $i_{OUT}$ AT MAXIMUM VALUE?
NO
YES
IS a AT MAXIMUM VALUE?
NO
616
YES
INCREASE a
620
628
INCREASE $i_{OUT}$
630
618
DECREASE $i_{OUT}$
DECREASE a

SYSTEMS AND METHODS FOR LOW-POWER LAMP COMPATIBILITY WITH A LEADING-EDGE DIMMER AND AN ELECTRONIC TRANSFORMER

RELATED APPLICATIONS

The present disclosure claims priority to United States Provisional Patent Application Ser. No. 61/736,942, filed Dec. 13, 2012, which is incorporated by reference herein in its entirety.

The present disclosure also claims priority to U.S. Provisional Patent Application Ser. No. 61/756,744, filed Jan. 25, 2013, which is incorporated by reference herein in its entirety.

FIELD OF DISCLOSURE

The present disclosure relates in general to the field of electronics, and more specifically to systems and methods for ensuring compatibility between one or more low-power lamps and the power infrastructure to which they are coupled.

BACKGROUND

Many electronic systems include circuits, such as switching power converters or transformers that interface with a dimmer. The interfacing circuits deliver power to a load in accordance with the dimming level set by the dimmer. For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers generate an output signal in which a portion of an alternating current ("AC") input signal is removed or zeroed out. For example, some analog-based dimmers utilize a triode for alternating current ("triac") device to modulate a phase angle of each cycle of an alternating current supply voltage. This modulation of the phase angle of the supply voltage is also commonly referred to as "phase cutting" the supply voltage. Phase cutting the supply voltage reduces the average power supplied to a load, such as a lighting system, and thereby controls the energy provided to the load.

A particular type of a triac-based, phase-cutting dimmer is known as a leading-edge dimmer. A leading-edge dimmer phase cuts from the beginning of an AC cycle, such that during the phase-cut angle, the dimmer is "off" and supplies no output voltage to its load, and then turns "on" after the phase-cut angle and passes phase-cut input signal to its load. To ensure proper operation, the load must provide to the leading-edge dimmer a load current sufficient to maintain an inrush current above a current necessary for maintaining conduction by the triac. Due to the sudden increase in voltage provided by the dimmer and the presence of capacitors in the dimmer, the current that must be provided is typically substantially higher than the steady state current necessary for triac conduction.

FIG. 1 depicts a lighting system 100 that includes a triac-based leading-edge dimmer 102 and a lamp 142. FIG. 2 depicts example voltage and current graphs associated with lighting system 100. Referring to FIGS. 1 and 2, lighting system 100 receives an AC supply voltage $V_{SUPPLY}$ from voltage supply 104. The supply voltage $V_{SUPPLY}$ is, for example, a nominally 60 Hz/110 V line voltage in the United States of America or a nominally 50 Hz/220 V line voltage in Europe. Triac 106 acts as a voltage-driven switch, and a gate terminal 108 of triac 106 controls current flow between the first terminal 110 and the second terminal 112. A gate voltage $V_G$ on the gate terminal 108 above a firing threshold voltage value $V_F$ will cause triac 106 to turn ON, in turn causing a short of capacitor 121 and allowing current to flow through triac 106 and dimmer 102 to generate an output current $i_{DIM}$.

Assuming a resistive load for lamp 142, the dimmer output voltage $V_{\Phi_DIM}$ is zero volts from the beginning of each of half cycles 202 and 204 at respective times $t_0$ and $t_2$ until the gate voltage $V_G$ reaches the firing threshold voltage value $V_F$. Dimmer output voltage $V_{\Phi_DIM}$ represents the output voltage of dimmer 102. During timer period $t_{OFF}$, the dimmer 102 chops or cuts the supply voltage $V_{SUPPLY}$ so that the dimmer output voltage $V_{\Phi_DIM}$ remains at zero volts during time period $t_{OFF}$. At time $t_1$, the gate voltage $V_G$ reaches the firing threshold value $V_F$, and triac 106 begins conducting. Once triac 106 turns ON, the dimmer voltage $V_{\Phi_DIM}$ tracks the supply voltage $V_{SUPPLY}$ during time period $t_{ON}$.

Once triac 106 turns ON, the current $i_{DIM}$ drawn from triac 106 must exceed an attach current $i_{ATT}$ in order to sustain the inrush current through triac 106 above a threshold current necessary for opening triac 106. In addition, once triac 106 turns ON, triac 106 continues to conduct current $i_{DIM}$ regardless of the value of the gate voltage $V_G$ as long as the current $i_{DIM}$ remains above a holding current value $i_{HC}$. The attach current value $i_{ATT}$ and the holding current value $i_{HC}$ are a function of the physical characteristics of the triac 106. Once the current $i_{DIM}$ drops below the holding current value $i_{HC}$, i.e. $i_{DIM}<i_{HC}$, triac 106 turns OFF (i.e., stops conducting), until the gate voltage $V_G$ again reaches the firing threshold value $V_F$. In many traditional applications, the holding current value $i_{HC}$ is generally low enough so that, ideally, the current $i_{DIM}$ drops below the holding current value $i_{HC}$ when the supply voltage $V_{SUPPLY}$ is approximately zero volts near the end of the half cycle 202 at time $t_2$.

The variable resistor 114 in series with the parallel connected resistor 116 and capacitor 118 form a timing circuit 115 to control the time $t_1$ at which the gate voltage $V_G$ reaches the firing threshold value $V_F$. Increasing the resistance of variable resistor 114 increases the time $t_{OFF}$, and decreasing the resistance of variable resistor 114 decreases the time $t_{OFF}$. The resistance value of the variable resistor 114 effectively sets a dimming value for lamp 142. Diac 119 provides current flow into the gate terminal 108 of triac 106. The dimmer 102 also includes an inductor choke 120 to smooth the dimmer output voltage $V_{\Phi_DIM}$. Triac-based dimmer 102 also includes a capacitor 121 connected across triac 106 and inductor choke 120 to reduce electro-magnetic interference.

Ideally, modulating the phase angle of the dimmer output voltage $V_{\Phi_DIM}$ effectively turns the lamp 142 OFF during time period $t_{OFF}$ and ON during time period $t_{ON}$ for each half cycle of the supply voltage $V_{SUPPLY}$. Thus, ideally, the dimmer 102 effectively controls the average energy supplied to lamp 142 in accordance with the dimmer output voltage $V_{\Phi_DIM}$.

The triac-based dimmer 102 adequately functions in many circumstances, such as when lamp 142 consumes a relatively high amount of power, such as an incandescent light bulb. However, in circumstances in which dimmer 102 is loaded with a lower-power load (e.g., a light-emitting diode or LED lamp), such load may draw a small amount of current $i_{DIM}$, and it is possible that the current $i_{DIM}$ may fail to reach the attach current $i_{ATT}$ and also possible that current $i_{DIM}$ may prematurely drop below the holding current value $i_{HC}$ before the supply voltage $V_{SUPPLY}$ reaches approximately zero volts. If the current $i_{DIM}$ fails to reach the attach current $i_{ATT}$, dimmer 102 may prematurely disconnect and may not pass the appropriate portion of input voltage $V_{SUPPLY}$ to its output. If the current $i_{DIM}$ prematurely drops below the holding current value $i_{HC}$, the dimmer 102 prematurely shuts down, and the dimmer voltage $V_{\Phi_DIM}$ will prematurely drop to zero. When the dimmer voltage $V_{\Phi_DIM}$ prematurely drops to zero, the dimmer voltage $V_{\Phi_DIM}$ does not reflect the intended dimming value as set by the resistance value of variable resistor 114. For example, when the current $i_{DIM}$ drops below the holding current value $i_{HC}$ at a time significantly earlier than $t_2$ for the dimmer voltage $V_{\Phi_DIM}$ 206, the ON time period $t_{ON}$ prematurely ends at a time earlier than $t_2$ instead of ending at time $t_2$, thereby decreasing the amount of energy delivered to the load. Thus, the energy delivered to the load will not match the dimming level corresponding to the dimmer voltage $V_{\Phi_DIM}$. In addition, when $V_{\Phi_DIM}$ prematurely drops to zero, charge may accumulate on capacitor 118 and gate 108, causing triac 106 to again refire if gate voltage $V_G$ exceeds firing threshold voltage $V_F$ during the same half cycle 202 or 204, and/or causing triac 106 to fire incorrectly in subsequent half cycles due to such accumulated charge. Thus, premature disconnection of triac 106 may lead to errors in the timing circuitry of dimmer 102 and instability in its operation.

Dimming a light source with dimmers saves energy when operating a light source and also allows a user to adjust the intensity of the light source to a desired level. However, conventional dimmers, such as a triac-based leading-edge dimmer, that are designed for use with resistive loads, such as incandescent light bulbs, often do not perform well when attempting to supply a raw, phase modulated signal to a reactive load such as an electronic power converter or transformer.

Transformers present in a power infrastructure may include magnetic or electronic transformers. A magnetic transformer typically comprises two coils of conductive material (e.g., copper) each wrapped around a core of material having a high magnetic permeability (e.g., iron) such that magnetic flux passes through both coils. In operation, an electric current in the first coil may produce a changing magnetic field in the core, such that the changing magnetic field induces a voltage across the ends of the secondary winding via electromagnetic induction. Thus, a magnetic transformer may step voltage levels up or down while providing electrical isolation in a circuit between components coupled to the primary winding and components coupled to the secondary winding.

On the other hand, an electronic transformer is a device which behaves in the same manner as a conventional magnetic transformer in that it steps voltage levels up or down while providing isolation and can accommodate load current of any power factor. An electronic transformer generally includes power switches which convert a low-frequency (e.g., direct current to 400 Hertz) voltage wave to a high-frequency voltage wave (e.g., in the order of 10,000 Hertz). A comparatively small magnetic transformer may be coupled to such power switches and thus provides the voltage level transformation and isolation functions of the conventional magnetic transformer.

FIG. 3 depicts a lighting system 101 that includes a triac-based leading-edge dimmer 102 (e.g., such as that shown in FIG. 1), an electronic transformer 122, and a lamp 142. Such a system 101 may be used, for example, to transform a high voltage (e.g., 110V, 220V) to a low voltage (e.g., 12V) for use with a halogen lamp (e.g., an MR16 halogen lamp). FIG. 4 depicts example voltage and current graphs associated with lighting system 101.

As is known in the art, electronic transformers operate on a principle of self-resonant circuitry. Referring to FIGS. 3 and 4, when dimmer 102 is used in connection with transformer 122 and a low-power lamp 142, the low current draw of lamp 142 may be insufficient to allow electronic transformer 122 to reliably self-oscillate.

To further illustrate, electronic transformer 122 may receive the dimmer output voltage $V_{\Phi_DIM}$ at its input where it is rectified by a full-bridge rectifier formed by diodes 124. As voltage $V_{\Phi_DIM}$ increases in magnitude at the dimmer firing point $t_1$, voltage on capacitor 126 may increase to a point where diac 128 will turn on, thus also turning on transistor 129. Once transistor 129 is on, capacitor 126 may be discharged and oscillation will start due to the self-resonance of switching transformer 130, which includes a primary winding ($T_{2a}$) and two secondary windings ($T_{2b}$ and $T_{2c}$). Accordingly, as depicted in FIG. 4, an oscillating output voltage $V_s$ 402 will be formed on the secondary of transformer 132 and delivered to lamp 142 while dimmer 102 is on, bounded by an AC voltage level proportional to $V_{\Phi_DIM}$.

However, as mentioned above, many electronic transformers will not function properly with low-current loads. With a light load, there may be insufficient current through the primary winding of switching transformer 130 to sustain oscillation. For legacy applications, such as where lamp 142 is a 35-watt halogen bulb, lamp 142 may draw sufficient current to allow transformer 122 to sustain oscillation. However, should a lower-power lamp be used, such as a six-watt LED bulb, the current drawn by lamp 142 may be insufficient to sustain oscillation in transformer 122, which may lead to unreliable effects, such as visible flicker and a reduction in total light output below the level indicated by the dimmer.

In addition, traditional approaches do not effectively detect or sense a type of transformer to which a lamp is coupled, further rendering it difficult to ensure compatibility between low-power (e.g., less than twelve watts) lamps and the power infrastructure to which they are applied.

SUMMARY

In accordance with the teachings of the present disclosure, certain disadvantages and problems associated with ensuring compatibility of a low-power lamp with a dimmer and a transformer may be reduced or eliminated.

In accordance with embodiments of the present disclosure, an apparatus may include a controller to provide compatibility between a load and a secondary winding of an electronic transformer driven by a leading-edge dimmer. The controller may be configured to, responsive to determining that energy is available from the electronic transformer, draw a requested amount of power from the electronic transformer thus transferring energy from the electronic transformer to an energy storage device in accordance with the requested amount of power. The controller may also be configured to transfer energy from the energy storage device to the load at a rate such that a voltage of the energy storage device is regulated within a predetermined voltage range.

In accordance with these and other embodiments of the present disclosure, a method to provide compatibility between a load and a secondary winding of the electronic transformer driven by a leading-edge dimmer may include, responsive to determining that energy is available from the electronic transformer, drawing a requested amount of power from the electronic transformer thus transferring energy from the electronic transformer to an energy storage device in accordance with the requested amount of power. The method may further include transferring energy from the energy storage device to the load at a rate such that a voltage of the energy storage device is regulated within a predetermined voltage range.

In accordance with these and other embodiments of the present disclosure, an apparatus may include a power converter and a controller. The controller may be configured to monitor a voltage at an input of the power converter, cause the power controller to transfer energy from the input to a load at a target current, decrease the target current responsive to determining that the voltage is less than or equal to an undervoltage threshold, and increase the target current responsive to determining that the voltage is greater than or equal to a maximum threshold voltage.

In accordance with these and other embodiments of the present disclosure, a method may include monitoring a voltage at an input of a power converter. The method may also include causing the power controller to transfer energy from the input to a load at a target current. The method may additionally include decreasing the target current responsive to determining that the voltage is less than or equal to an undervoltage threshold. The method may further include increasing the target current responsive to determining that the voltage is greater than or equal to a maximum threshold voltage. Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 6 illustrates a flow chart of an example method for ensuring compatibility between a lamp and an electronic transformer driver by a leading-edge dimmer, in accordance with embodiments of the present disclosure.

DETAILED DESCRIPTION

Figure 5:
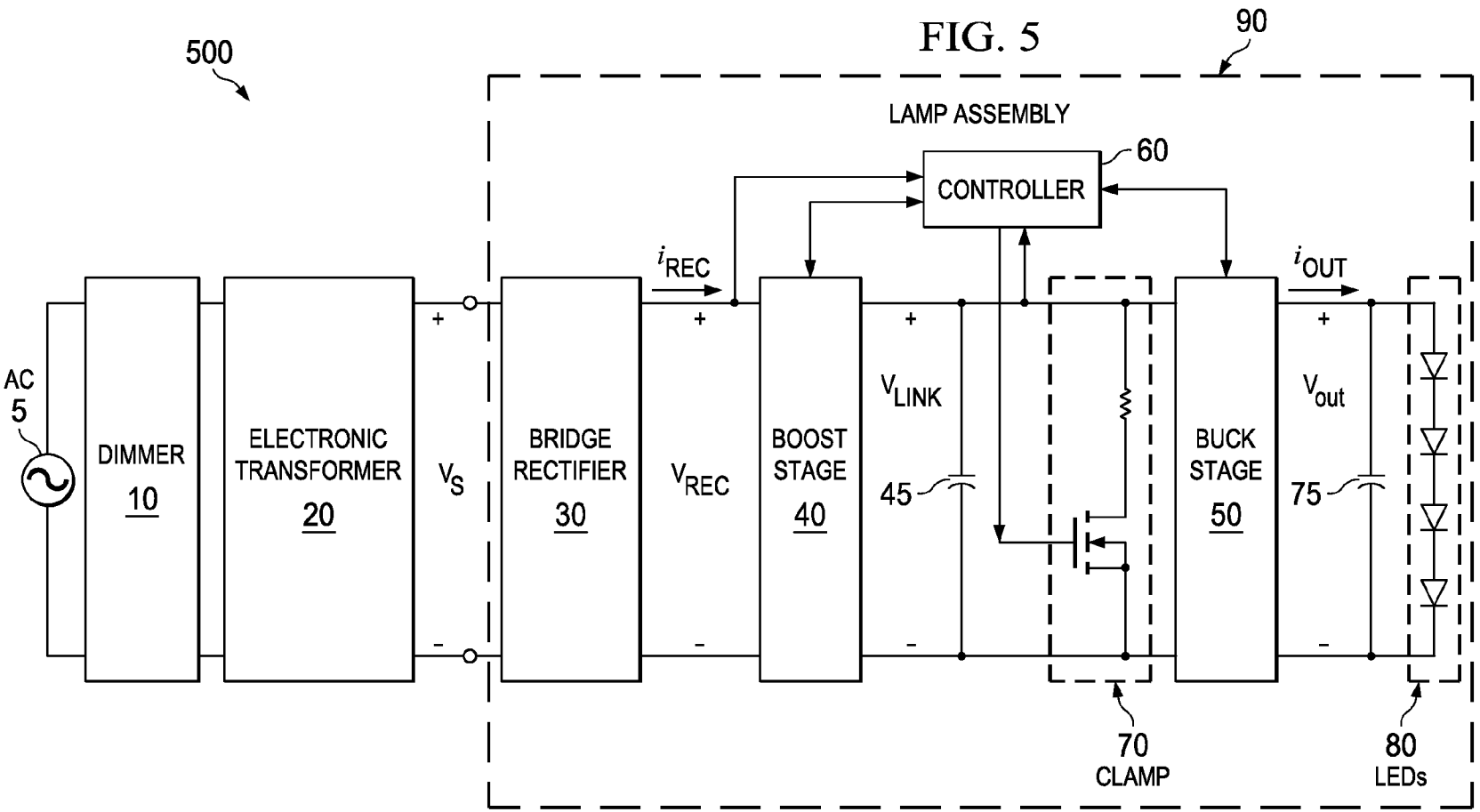
FIG. 5 illustrates an example lighting system including a controller for providing compatibility between a low-power lamp and other elements of a lighting system, in accordance with embodiments of the present disclosure.

FIG. 5 illustrates an example lighting system 500 including a controller 60 integral to a lamp assembly 90 for providing compatibility between a low-power light source (e.g., LEDs 80) and other elements of lighting system 500, in accordance with embodiments of the present disclosure. As shown in FIG. 5, lightning system 500 may include a voltage supply 5, a leading-edge dimmer 10, an electronic transformer 20, and a lamp assembly 90. Voltage supply 5 may generate a supply voltage that is, for example, a nominally 60 Hz/110 V line voltage in the United States of America or a nominally 50 Hz/220 V line voltage in Europe.

Figure 1:
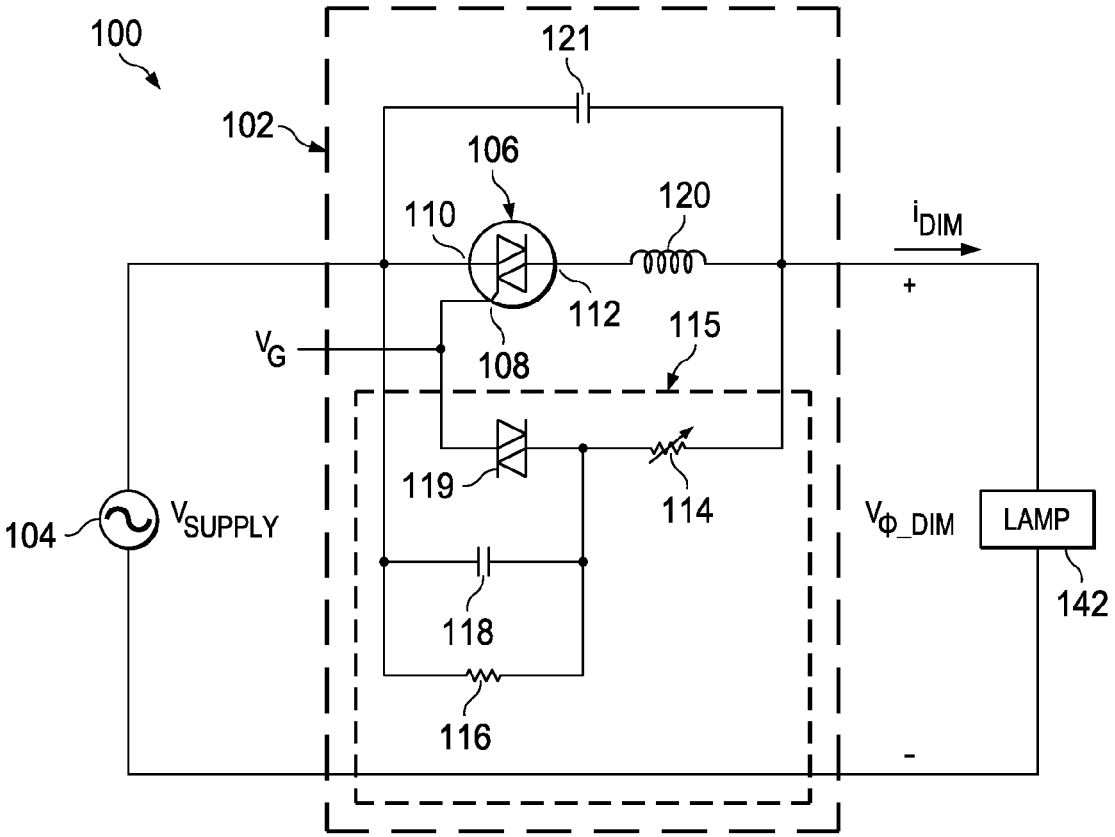
FIG. 1 (PRIOR ART)
FIG. 1 illustrates a lighting system that includes a triac-based leading-edge dimmer, as is known in the art.
Figure 2:
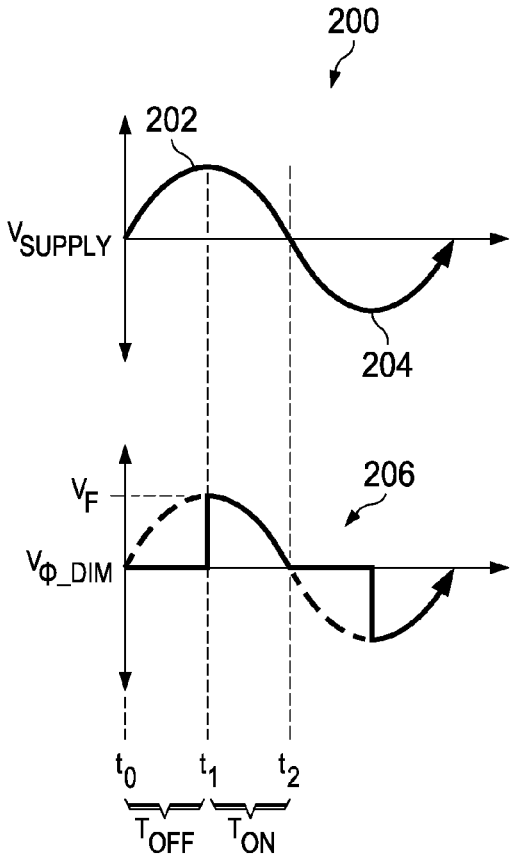
FIG. 2 (PRIOR ART)
FIG. 2 illustrates example voltage and current graphs associated with the lighting system depicted in FIG. 1, as is known in the art.
Figure 4:
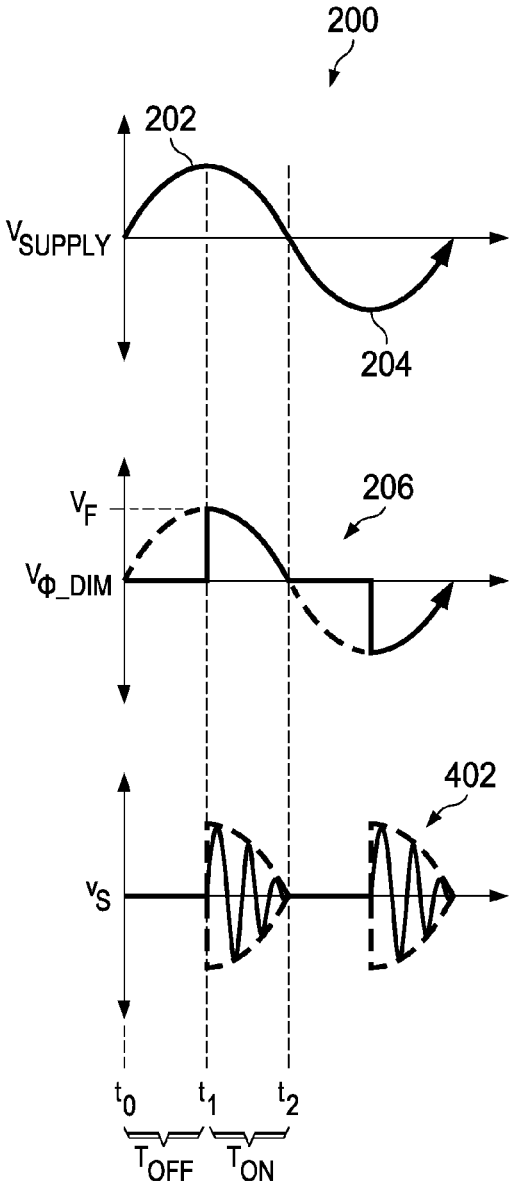
FIG. 4 (PRIOR ART)
FIG. 4 illustrates example voltage and current graphs associated with the lighting system depicted in FIG. 3, as is known in the art.
Figure 3:
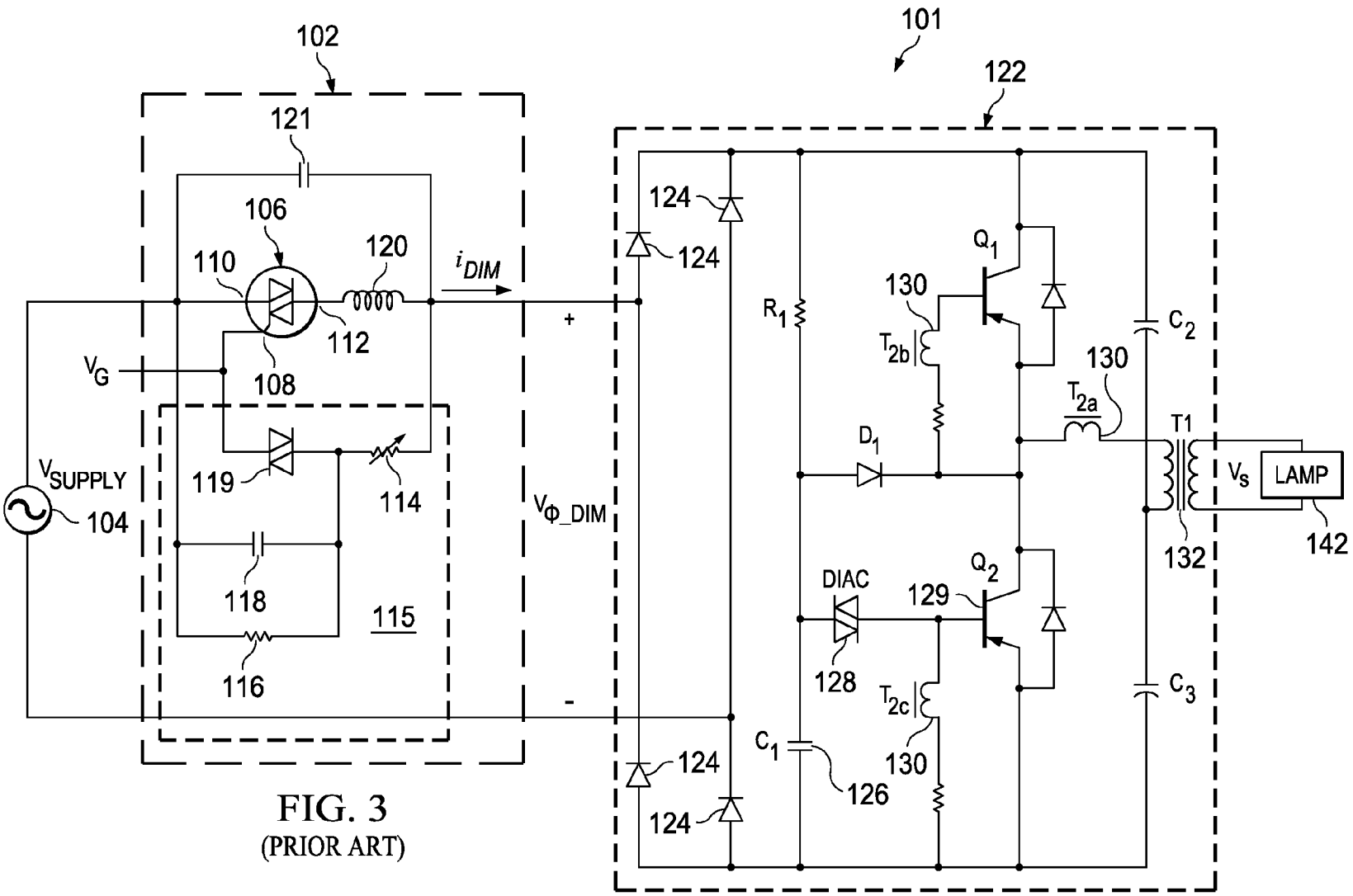
FIG. 3 (PRIOR ART)
FIG. 3 illustrates a lighting system that includes a triac-based leading-edge dimmer and an electronic transformer, as is known in the art.

Leading-edge dimmer 10 may comprise any system, device, or apparatus for generating a dimming signal to other elements of lighting system 500, the dimming signal representing a dimming level that causes lighting system 500 to adjust power delivered to lamp assembly 90, and, thus, depending on the dimming level, increase or decrease the brightness of LEDs 80 or another light source integral to lamp assembly 90. Thus, leading-edge dimmer 10 may include a leading-edge dimmer similar or identical to that depicted in FIGS. 1 and 3.

Electronic transformer 20 may comprise any system, device, or apparatus for transferring energy by inductive coupling between winding circuits of transformer 20. Thus, electronic transformer 20 may include a magnetic transformer similar or identical to that depicted in FIG. 3, or any other suitable transformer.

Lamp assembly 90 may comprise any system, device, or apparatus for converting electrical energy (e.g., delivered by electronic transformer 20) into photonic energy (e.g., at LEDs 80). In some embodiments, lamp assembly 90 may comprise a multifaceted reflector form factor (e.g., an MR16 form factor). In these and other embodiments, lamp assembly 90 may comprise an LED lamp. As shown in FIG. 5, lamp assembly 90 may include a bridge rectifier 30, a boost converter stage 40, a link capacitor 45, a buck converter stage 50, a load capacitor 75, a power-dissipating clamp 70, LEDs 80, and a controller 60.

Bridge rectifier 30 may comprise any suitable electrical or electronic device as is known in the art for converting the whole of alternating current voltage signal $v_s$ into a rectified voltage signal $v_{REC}$ having only one polarity.

Boost converter stage 40 may comprise any system, device, or apparatus configured to convert an input voltage (e.g., $v_{REC}$) to a higher output voltage (e.g., $v_{LINK}$) wherein the conversion is based on a control signal (e.g., a control signal communicated from controller 60, as explained in greater detail below). Similarly, buck converter stage 50 may comprise any system, device, or apparatus configured to convert an input voltage (e.g., $v_{LINK}$) to a lower output voltage (e.g., $v_{OUT}$) wherein the conversion is based on another control signal (e.g., another control signal communicated from controller 60, as explained in greater detail below).

Each of link capacitor 45 and output capacitor 75 may comprise any system, device, or apparatus store energy in an electric field. Link capacitor 45 may be configured such that it stores energy generated by boost converter stage 40 in the form of the voltage $v_{LINK}$. Output capacitor 75 may be configured such that it stores energy generated by buck converter stage 50 in the form of the voltage $v_{OUT}$.

Power-dissipating clamp 70 may comprise any system, device, or apparatus configured to, when selectively activated, dissipate energy stored on link capacitor 45, thus decreasing voltage $v_{LINK}$. In embodiments represented by FIG. 5, clamp 70 may comprise a resistor in series with a switch (e.g., a transistor), such that clamp 70 may be selectively enabled and disabled based on a control signal communicated from controller 60 for controlling the switch.

LEDs 80 may comprise one or more light-emitting diodes configured to emit photonic energy in an amount based on the voltage $V_{OUT}$ across the LEDs 80.

Controller 60 may comprise any system, device, or apparatus configured to, as described in greater detail elsewhere in this disclosure, determine a voltage $v_{REC}$ present at the input of boost converter stage 40 and control an amount of current $i_{REC}$ drawn by the boost converter stage and/or control an amount of current $i_{OUT}$ delivered by buck stage 50 based on such voltage $v_{REC}$. In addition or alternatively, controller 60 may be configured to, described in greater detail elsewhere in this disclosure, determine a voltage $v_{LINK}$ present at the output of boost converter stage 40 and control an amount of current $i_{OUT}$ delivered by buck stage 50 and/or selectively enable and disable clamp 70 based on such voltage $v_{LINK}$.

In operation, controller 60 may, when power is available from electronic transformer 20 and based on a measured voltage $v_{REC}$, generate current $i_{REC}$ inversely proportional to $v_{REC}$ (e.g., $i_{REC}=P/v_{REC}$, where P is a predetermined power, as described elsewhere in this disclosure). Thus, as voltage $v_{REC}$ increases, controller 60 may cause current $i_{REC}$ to decrease, and as voltage $v_{REC}$ decreases, controller 60 may cause current $i_{REC}$ to increase. In addition, controller 60 may cause buck converter stage 50 to output a constant current in an amount necessary to regulate voltage $v_{LINK}$ at a voltage level well above the maximum output voltage $v_s$ of electronic transformer 20, as described in greater detail elsewhere in this disclosure.

To regulate voltage $v_{LINK}$, controller 60 may sense voltage $v_{LINK}$ and control the current $i_{OUT}$ generated by buck converter stage 50 based on the sensed voltage $v_{LINK}$. For example, if voltage $v_{LINK}$ falls below a first undervoltage threshold, such event may indicate that buck converter stage 50 is drawing more power than boost converter stage 40 can supply. In response, controller 60 may cause buck converter 50 to decrease the current $i_{OUT}$ until voltage $v_{LINK}$ is no longer below the first undervoltage threshold. In some embodiments, controller 60 may implement a low-pass filter via which current $i_{OUT}$ is decreased, in order to prevent oscillation or hard steps in the visible light output of LEDs 80. As another example, should voltage $v_{LINK}$ fall below a second undervoltage threshold with a magnitude lower than the first undervoltage threshold, the bandwidth of the low-pass filter implemented by controller 60 may be increased for as long as voltage $v_{LINK}$ remains below the second undervoltage threshold, in order to prevent voltage $v_{LINK}$ from collapsing to the point in which it can no longer be regulated.

As a further example, if voltage $v_{LINK}$ rises above a maximum threshold voltage, such event may indicate that boost converter stage 40 is generating more power than buck converter stage 50 can consume. In response, controller 60 may cause buck converter 50 to increase the current $i_{OUT}$ until voltage $v_{LINK}$ is no longer above the maximum threshold voltage. In some embodiments, controller 60 may implement a low-pass filter via which current $i_{OUT}$ is increased, in order to prevent oscillation or hard steps in the visible light output of LEDs 80. In addition or alternatively, responsive to voltage $v_{LINK}$ rising above the maximum threshold voltage, controller 60 may activate power-dissipating clamp 70 to reduce voltage $v_{LINK}$.

Accordingly, controller 60, in concert with boost converter stage 40, buck converter stage 50, and clamp 70, may provide an input current waveform $i_{REC}$ which increases as voltage $v_{REC}$ decreases and decreases as voltage $v_{REC}$ increases, and provides hysteretic power regulation of the output of boost converter stage 40. In some embodiments, controller 60 may meet the requirement of increasing current $i_{REC}$ with decreasing voltage $v_{REC}$ and decreasing current $i_{REC}$ with increasing voltage $v_{REC}$ by producing a substantially constant power across the AC waveform of $v_{REC}$.

As described above, an electronic transformer is designed to operate on a principle of self-oscillation, wherein current feedback from its output current is used to force oscillation of the electronic transformer. If the load current is below the current necessary to activate transistor base currents (e.g., in transistor 129 depicted in FIG. 3) in the positive feedback loop of the electronic transformer, oscillation may fail to sustain itself, and the output voltage and output current of the electronic transformer will fall to zero.

In lighting system 500, because boost converter stage 40 is generating a substantially constant power proportional to the dimmer output, the current drawn from electronic transformer 20 is a minimum when the voltage $v_{REC}$ (and thus voltage $v_s$) is at its maximum magnitude. With many electronic transformers, such minimum current may fall below the current necessary to sustain oscillation in the electronic transformer. This failure to maintain oscillation results in a lack of energy available from the transformer and ultimately results in an output at LEDs 80 below the desired value.

Accordingly, in addition to the functionality described above, controller 60 may also implement a servo loop to control the power value used to calculate current $i_{REC}$ based on voltage $v_{REC}$. In accordance with such servo loop, controller 60 may generate current $i_{REC}$ in accordance with the equation $i_{REC}=aP/v_{REC}$, wherein a is a dimensionless variable multiplier having a value based on at least one of voltage $v_{REC}$ and an output power generated by buck converter stage 50 (as described in greater detail below), and P is a rated power of LEDs 80. At startup of controller 60, controller 60 may set a to its maximum value (e.g., 2). For increasing phase angles of dimmer 10, the current drawn by boost converter stage 40 will be at an elevated level ($i_{REC}=aP/v_{REC}$, where a is at its maximum), until the power output of buck converter stage 50 reaches its maximum (e.g., P) and clamp 70 remains activated. At this point, because output power of buck converter stage 50 is at its maximum, the power generated by boost converter stage 40 may be reduced and still maintain generation of the same existing light output on LEDs 80. Thus, because output power of buck converter stage 50 is at its maximum and clamp 70 is activated (e.g., voltage $v_{LINK}$ is above the aforementioned maximum threshold voltage), controller 60 may decrease the value of a until either clamp 70 is no longer activated (e.g., voltage $v_{LINK}$ is no longer above the aforementioned maximum threshold voltage) or a reaches its minimum level (e.g., a=1, corresponding to power generation of boost converter stage 40 being equal to rated power of LEDs 80). Conversely, when the phase angle of dimmer 10 is decreased and voltage $v_{LINK}$ begins approaching the aforementioned first threshold, controller 60 may increase a. Once a is increased to its maximum value (e.g., a=2), controller 60 may decrease current $i_{OUT}$ based on voltage $v_{LINK}$, as described above.

In some embodiments, controller 60 may include a microprocessor, microcontroller, digital signal processor (DSP), application specific integrated circuit (ASIC), or any other digital or analog circuitry configured to interpret and/or execute program instructions and/or process data. In some embodiments, controller 60 may interpret and/or execute program instructions and/or process data stored in a memory (not explicitly shown) communicatively coupled to controller 60.

FIG. 6 illustrates a flow chart of an example method 600 for ensuring compatibility between a lamp and an electronic transformer driven by a leading-edge dimmer, in accordance with embodiments of the present disclosure. According to some embodiments, method 600 may begin at step 601. As noted above, teachings of the present disclosure may be implemented in a variety of configurations of lighting system 500. As such, the preferred initialization point for method 600 and the order of the steps comprising method 600 may depend on the implementation chosen.

At step 601, controller 60 may set variable a to its maximum value (e.g., 2).

At step 602, controller 60 may determine if energy is available to first power converter stage 40 from electronic transformer 20. If energy is available to first power converter stage 40 from electronic transformer 20, method 600 may proceed to step 604. Otherwise, method 600 may proceed to step 606.

At step 604, responsive to a determination that energy is available to first power converter stage 40 from electronic transformer 20, controller 60 may cause boost converter stage 40 to draw current $i_{REC}$ in accordance with the equation $i_{REC}=aP/v_{REC}$, wherein a is a dimensionless variable multiplier having a value based on at least one of voltage $v_{REC}$ and an output power generated by buck converter stage 50, and P is a rated power of LEDs 80.

At step 606, controller 60 may cause buck converter stage 50 to generate a current $i_{OUT}$. During the first execution of step 606, controller 60 may cause buck converter stage 50 to generate a predetermined initial value of current $i_{OUT}$ (e.g., a percentage of the maximum current $i_{OUT}$ which may be generated by buck converter stage 50). Afterwards, current $i_{OUT}$ may change as set forth elsewhere in the description of method 600.

At step 608, controller 60 may determine if voltage $v_{LINK}$ is less than a first undervoltage threshold. If voltage $v_{LINK}$ is less than the first undervoltage threshold, method 600 may proceed to step 610. Otherwise, method 600 may proceed to step 622.

At step 610, responsive to a determination that voltage $v_{LINK}$ is less than the first undervoltage threshold, controller 60 may determine if voltage $v_{LINK}$ is less than a second undervoltage threshold lower than the first undervoltage threshold. If voltage $v_{LINK}$ is less than the second undervoltage threshold, method 600 may proceed to step 612. Otherwise, method 600 may proceed to step 614.

At step 612, responsive to a determination that voltage $v_{LINK}$ is less than the second undervoltage threshold, controller 60 may select a higher-bandwidth low-pass filter via which current $i_{OUT}$ may be decreased, as described in greater detail below.

At step 614, responsive to a determination that voltage $v_{LINK}$ is more than the second undervoltage threshold, controller 60 may select a lower-bandwidth low-pass filter in which current $i_{OUT}$ may be decreased, as described in greater detail below, wherein the lower-bandwidth low-pass filter has a bandwidth lesser than that of the higher-bandwidth low-pass filter.

At step 616, controller 60 may determine if variable a is at its maximum value (e.g., a=2). If variable a is at its maximum value, method 600 may proceed to step 618. Otherwise, method 600 may proceed to step 620.

At step 618, in response to a determination that variable a is at its maximum value, controller 60 may cause buck converter stage 50 to decrease current $i_{OUT}$ delivered to LEDs 80. Controller 60 may implement a low-pass filter (e.g., selected in either of steps 612 or 614) in which it causes buck converter stage 50 to decrease current $i_{OUT}$. After completion of step 618, method 600 may proceed again to step 602.

At step 620, in response to a determination that variable a is less than its maximum value, controller 60 may increase the variable a. After completion of step 620, method 600 may proceed again to step 602.

At step 622, responsive to a determination that voltage $v_{LINK}$ is greater than the first undervoltage threshold, controller 60 may determine if voltage $v_{LINK}$ is greater than a maximum threshold voltage. If voltage $v_{LINK}$ is greater than a maximum threshold voltage, method 600 may proceed to step 624. Otherwise, method 600 may proceed again to step 602.

At step 624 responsive to a determination that voltage $v_{LINK}$ is greater than the maximum threshold voltage, controller 60 may activate clamp 70 in order to reduce voltage $v_{LINK}$.

At step 626, controller 60 may determine if current $i_{OUT}$ is at its maximum value (e.g., buck converter 50 producing maximum power in accordance with the power rating of LEDs 80). If current $i_{OUT}$ is at its maximum value, method 600 may proceed to step 628. Otherwise, method 600 may proceed to step 630.

At step 628, in response to a determination that current $i_{OUT}$ is at its maximum value, controller 60 may decrease the variable a. After completion of step 618, method 600 may proceed again to step 602.

At step 630, in response to a determination that current $i_{OUT}$ is less than its maximum value, controller 60 may cause buck converter 50 to increase current $i_{OUT}$. Controller 60 may implement a low-pass filter in which it causes buck converter stage 50 to increase $i_{OUT}$. After completion of step 620, method 600 may proceed again to step 602.

Although FIG. 6 discloses a particular number of steps to be taken with respect to method 600, method 600 may be executed with greater or fewer steps than those depicted in FIG. 6. In addition, although FIG. 6 discloses a certain order of steps to be taken with respect to method 600, the steps comprising method 600 may be completed in any suitable order.

Method 600 may be implemented using controller 60 or any other system operable to implement method 600. In certain embodiments, method 600 may be implemented partially or fully in software and/or firmware embodied in computer-readable media.

Thus, in accordance with the methods and systems disclosed herein, controller 60 causes lamp assembly 90 to, draw a first amount of power from the electronic transformer, the first amount of power comprising a maximum amount of a requested amount of power available from the electronic transformer, thus transferring energy from the electronic transformer to an energy storage device (e.g., link capacitor 45) in accordance with the first amount of power, wherein the first amount of power equals the product of voltage $v_{REC}$ and the current $i_{REC}$. In addition, controller 60 causes lamp assembly 90 to transfer energy from the energy storage device (e.g., link capacitor 45) to a load (e.g., LEDs 80) at a rate (e.g., current $i_{OUT}$) such that a voltage (e.g., $v_{LINK}$) of the energy storage device is regulated within a predetermined voltage range (e.g., above the undervoltage thresholds and below the maximum threshold voltage). In addition, responsive to determining that the first amount of power is greater than a maximum amount of power deliverable to the load, controller 60 may cause lamp assembly 90 to decrease the requested amount of power (e.g., decrease a).

As used herein, when two or more elements are referred to as "coupled" to one another, such term indicates that such two or more elements are in electronic communication whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. An apparatus comprising a controller to provide compatibility between a load and a secondary winding of an electronic transformer driven by a leading-edge dimmer, wherein the controller is configured to:

draw a first amount of power from the electronic transformer, the first amount of power comprising a maximum amount of a requested amount of power available from the electronic transformer, thus transferring energy from the electronic transformer to an energy storage device in accordance with the first amount of power;

transfer energy from the energy storage device to the load at a rate such that a voltage of the energy storage device is regulated within a predetermined voltage range; and responsive to determining that the first amount of power is greater than a maximum amount of power deliverable to the load, decrease the requested amount of power.

2. The apparatus of claim 1, wherein the controller is further configured to draw a current from the electronic transformer based on an output voltage of the secondary winding of the electronic transformer and the requested amount of power.

3. The apparatus of claim 2, further comprising a power converter stage coupled to the controller and configured to couple at its input to the secondary winding of the electronic transformer, and wherein the controller is further configured to cause the power converter stage to draw the current from the electronic transformer.

4. The apparatus of claim 3, wherein the power converter stage comprises a boost converter.

5. The apparatus of claim 3, wherein the power converter stage is configured to couple its input to the secondary winding of the electronic transformer via a bridge rectifier.

6. The apparatus of claim 2, wherein the controller is further configured to draw the current from the electronic transformer such that the current increases as the magnitude of the output voltage of the secondary winding of the electronic transformer decreases and the current decreases as the magnitude of the output voltage of the secondary winding of the electronic transformer increases.

7. The apparatus of claim 5, wherein the current is inversely proportional to the magnitude of the output voltage of the secondary winding of the electronic transformer.

8. The apparatus of claim 2, wherein the controller is configured to draw the current i in accordance with the equation $i=aP/v$, where P equals a predetermined amount of power, v equals the magnitude of the output voltage of the secondary winding of the electronic transformer, and a equals a variable multiplier having a value based on at least one of the voltage of the energy storage device and an output power delivered to the load such that a multiplied by P equals the requested amount of power.

9. The apparatus of claim 8, wherein the predetermined power is a power rating of the load.

10. The apparatus of claim 1, wherein the controller is further configured to deliver a current to the load, wherein the rate is a function of the current.

11. The apparatus of claim 10, further comprising a power converter stage configured to couple at its input to the energy storage device and wherein the controller is further configured to cause the power converter stage to deliver the current to the load based at least on the voltage of the energy storage device.

12. The apparatus of claim 11, wherein the power converter stage comprises a buck converter.

13. The apparatus of claim 10, wherein the controller is configured to decrease the current responsive to a determination that the voltage of the energy storage device is below a first undervoltage threshold.

14. The apparatus of claim 13, wherein the controller implements a low-pass filter and decreases the current via the low-pass filter.

15. The apparatus of claim 14, wherein the controller is further configured to select a first bandwidth for the low-pass filter responsive to a determination that the voltage of the energy storage device is below a second undervoltage threshold lower in magnitude than the first undervoltage threshold and select a second bandwidth for the low-pass filter responsive to a determination that voltage of the energy storage device is below the second undervoltage threshold, wherein the second bandwidth is less than the first bandwidth.

16. The apparatus of claim 10, wherein the controller is configured to increase the current responsive to a determination that the voltage of the energy storage device is above a maximum threshold voltage.

17. The apparatus of claim 16, wherein the controller implements a low-pass filter and increases the current via the low-pass filter.

18. The apparatus of claim 10, further comprising a power-dissipating clamp coupled to energy storage device, wherein the controller is further configured to cause the power-dissipating clamp to decrease the voltage of the energy storage device responsive to the determination that the voltage of the energy storage device is above the maximum threshold voltage.

19. The apparatus of claim 1, wherein the energy storage device is a capacitor.

20. The apparatus of claim 1, wherein the load is a light source.

21. The apparatus of claim 20, wherein the light source comprises a light-emitting diode lamp.

22. The apparatus of claim 20, wherein the load, the energy storage device, and the controller are integral to a single lamp assembly.

23. A method to provide compatibility between a load and a secondary winding of the electronic transformer driven by a leading-edge dimmer, comprising:

drawing a first amount of power from the electronic transformer, the first amount of power comprising a maximum amount of a requested amount of power available from the electronic transformer, thus transferring energy from the electronic transformer to an energy storage device in accordance with the first amount of power;

transferring energy from the energy storage device to the load at a rate such that a voltage of the energy storage device is regulated within a predetermined voltage range; and responsive to determining that the first amount of power is greater than a maximum amount of power deliverable to the load, decreasing the requested amount of power.

24. The method of claim 23, wherein the controller is further configured to draw a current from the electronic transformer based on an output voltage of the secondary winding of the electronic transformer and the requested amount of power.

25. The method of claim 24, further comprising drawing the current from the electronic transformer such that the current increases as the magnitude of the output voltage of the secondary winding of the electronic transformer decreases and the current decreases as the magnitude of the output voltage of the secondary winding of the electronic transformer increases.

26. The method of claim 25, wherein the current is inversely proportional to the magnitude of the output voltage of the secondary winding of the electronic transformer.

27. The method of claim 24, further comprising drawing the current i in accordance with the equation $i=aP/v$, where P equals a predetermined amount of power, v equals the magnitude of the output voltage of the secondary winding of the electronic transformer, and a equals a variable multiplier having a value based on at least one of the voltage of the energy storage device and an output power delivered to the load such that a multiplied by P equals the requested amount of power.

28. The method of claim 27, wherein the predetermined power is a power rating of the load.

29. The method of claim 23, further comprising delivering a current to the load, wherein the rate is a function of the current.

30. The method of claim 29, further comprising decreasing the current responsive to a determination that the voltage of the energy storage device is below a first undervoltage threshold.

31. The method of claim 30, further comprising decreasing the current via a low-pass filter.

32. The method of claim 31, further comprising selecting a first bandwidth for the low-pass filter responsive to a determination that the voltage of the energy storage device is below a second undervoltage threshold lower in magnitude than the first undervoltage threshold and selecting a second bandwidth for the low-pass filter responsive to a determination that voltage of the energy storage device is below the second undervoltage threshold, wherein the second bandwidth is less than the first bandwidth.

33. The method of claim 29, further comprising increasing the current responsive to a determination that the voltage of the energy storage device is above a maximum threshold voltage.

34. The method of claim 33, further comprising increasing the current via a low-pass filter.

35. The method of claim 29, further comprising decreasing the voltage of the energy storage device responsive to the determination that the voltage of the energy storage device is above the maximum threshold voltage.

36. The method of claim 23, wherein the energy storage device is a capacitor.

37. The method of claim 23, wherein the load is a light source.

38. The method of claim 37, wherein the light source comprises a light-emitting diode lamp.

39. The method of claim 37, wherein the load, the energy storage device, and the controller are integral to a single lamp assembly.

* * * * *